United States Patent [19]

Wilson

[11] 4,178,235

[45] Dec. 11, 1979

[54] FLOTATION RECOVERY OF PYROCHLORE

[76] Inventor: James A. Wilson, 13 Hilltop Rd., Port Washington, N.Y. 11050

[21] Appl. No.: 921,116

[22] Filed: Jun. 30, 1978

[51] Int. Cl.[2] ..... B03D 1/02

[52] U.S. Cl. ..... 209/166

[58] Field of Search ..... 209/166, 167

[56] References Cited

U.S. PATENT DOCUMENTS

| | | | |
|---|---|---|---|
| 2,875,896 | 3/1959 | Last | 209/166 |
| 2,953,569 | 9/1960 | Last | 209/166 X |
| 2,959,281 | 11/1960 | Faucher | 209/166 X |
| 3,430,765 | 3/1969 | Allen | 209/166 X |

*Primary Examiner*—Robert Halper

[57] ABSTRACT

Pyrochlore, an economically important mineral source of niobium and tantalum, is recovered by flotation. Normally this requires numerous stages of concentrate cleaning because of the physical character of the froth, i.e., its consistency and stability.

The use of 5-hydroxy quinoline as the collector/frother provides a froth with improved physical properties permitting a reduction of the required number of stages of flotation cleaning and improved recovery at a required concentrate grade.

3 Claims, No Drawings

FLOTATION RECOVERY OF PYROCHLORE

BACKGROUND OF INVENTION

Pyrochlore is a mineral source of niobium and tantalum. It is found associated with felspars, apatite, calcite, ilmenite and magnetite from magmatic segregation and alteration of calcic primary rock.

Pyrochlore is obtained in a concentrate by froth flotation of the ore, suitably ground and with appropriate reagents called collectors or promoters. These reagents are concentrated in the air/liquid interface of the froth and the particles of pyrochlore are selectively attracted by the reagents, coating the froth bubbles. The froth is generated by mechanical action in machines which are widely used for this purpose by the mineral industry. The froth overflows carrying the concentrate.

Prior to flotation the niobium/tantalum ore is crushed and then ground wet to a fineness which is appropriate for substantial liberation of the pyrochlore. It is not desirable to grind much finer than is required for substantial liberation of pyrochlore, not only because of the grinding energy but also because the flotation concentration and recovery are less efficient for the finer sizes. Many of the ores require grinding to about 90% minus 200 mesh for substantial liberation.

The process of mineral separation by froth flotation is not a perfect one for pyrochlore because minerals other than pyrochlore gather, or are mechanically carried, in the froth. They are selectively dislodged from the air/-water interfaces of the bubbles and cascade downward through the froth. A particle of pyrochlore may also become dislodged but it is picked up on another bubble and carried upward.

As a consequence of this continuing separation an assay of mineral grade will reveal the highest concentration of pyrochlore at the top of the froth layer which overflows into a concentrate launder and a progressively lower concentration going downward in the froth layer.

This process of enrichment is facilitated if the froth is "brittle", i.e., if the bubbles tend to break and release the minerals with some frequency, and it is also facilitated by "crowding," i.e., by a high concentration of particles in the froth so that the more strongly attracted particles tend to replace the others.

The physical characteristics of the flotation froth are therefore exceedingly important to achievement of an effective recovery and concentration. Unfortunately the froth character for the reagents which are used in the prior art is not very satisfactory. Collectors for pyrochlore also serve as frothers and, in combination with other additives, determine the froth characteristics.

These froths are generally describable as "soapy," i.e., they tend to resemble (as an extreme example, somewhat exaggerated) a lather with very fine and stable bubbles. Rejection of undersized gangue mineral from such a froth is obviously slow and imperfect.

The result of this impediment to effective separation in the froth layer is that in the commerical concentration of pyrochlore ores five or more stages of "cleaning" are required to concentrate from the crude ore to the final concentrate. Cleaning is a term applied to the retreatment by flotation of the "rougher" concentrate which is obtained from flotation of the crude ore.

The first cleaner concentrate, still unsatisfactory in grade, is then refloated in another cleaner stage. The cleaner tailings of each stage are returned to a preceding cleaner feed or to the rougher circuit feed. This entire system represents a counter-current separation as in the rectification section of a distillation column. It should be mentioned that the return of cleaner tailings to the rougher circuit entails a significant loss of pyrochlore in the rougher tails which are discarded.

Typical of the prior art methods are those claimed in U.S. Pat. No. 2,951,585 for aliphatic amines and U.S. Pat. No. 2,875,896 for 8-hydroxy quinoline, also known as quinolinol-8 and oxine. Both of these disclose the results of laboratory tests which indicate the recoveries which are achieved at various ratios of concentration in rougher separation and, in some cases, first and second stage cleaner flotation separation.

Neither of these discloses the result of a "locked" test in which cleaner tailings are refloated until there are no middling fractions but only a single concentrate and a single tailing.

OBJECT OF INVENTION

The object of this invention is to provide a collector/-frother which may be used for flotation froth concentration of pyrochlore ore and produce a froth which is more brittle than those of the prior art while retaining the selective chemical affinity for the pyrochlore.

Achievement of this objective permits the more efficient separation in the froth of the valued mineral with achievement of the desired concentrate grade with fewer cleaner stages and improved recovery.

SUMMARY OF INVENTION

I have discovered that 5-hydroxyquinoline as a collector/frother produces a more brittle forth than 8-hydroxyquinoline and other reagents of the prior art. It produces a froth which is less soapy and more hydrophobic when fully loaded with pyrochlore mineral.

In the practise of this invention I utilize the known techniques of the prior art preparatory to flotation concentration. Thus, for example, an ore ground to the extent required for mineral liberation, e.g., 90% minus 200 mesh, is deslimed. Desliming removes some of the softer gangue minerals and reduces the tendency of the pyrochlore mineral particles to become slime-coated and lost to collection.

Depending on the ore, magnetic separation prior to flotation may be used to remove magnetic minerals, e.g., ilmenite and magnetite. This is also a method of the prior art.

In the determination of the quantity of 5-hydroxyquinoline and other accessory reagents in the treatment of a pyrochlore ore for rougher flotation, an appropriate test procedure is to grind a charge quantity of one kilo of ore with water sufficient to cover the charge of 2 inch steel balls in a standard 25 cm diameter laboratory mill and grind for a designated time, say 10 minutes.

After grinding the charge from the mill is emptied through a coarse screen to retain the balls and permit transfer of the ground ore and water into a 1.0 liter laboratory flotation cell.

This pulp is agitated for conditioning for 30 seconds in a laboratory Fagergren flotation machine while adding the reagent, 2 grams of 5-hydroxyquinoline. Depending on the ore and subject to test, about 10 to 20 drops of mineral oil may be added. This tends to produce a stiffer froth, yet one which consists of large bubbles subject to easy rupture when loaded with mineral.

The air valve of the machine, shut during conditioning, is next opened. As the froth collects it is skimmed for 2 minutes. Collected froth is retained for a subsequent cleaning treatment performed in the same manner as the roughter flotation, but with addition of various conditioners and froth modifiers. These will depend on the ore character.

Among the conditioners are sodium sulfide to depress magnetite and various deflocculating agents to improve the separation, among them lignin sulfonates.

The pH of flotation is preferably from 6.0 to 7.0 in the rougher circuit and in the initial stages of cleaning. It should be reduced to about 3.0 in the final stages of cleaning so that alkaline minerals such as calcite may be chemically altered to a form which is rejected into the tailings. Sulfuric acid and other mineral acids are suitable for pH adjustment.

All of the foregoing methods of a test program are applicable to the methods of the prior art as well as to the present invention. They may be implemented in commerical concentrator practise as is well known. Specific treatment procedures depend on the characteristics and mineral composition of each ore.

The quantity of 5-hydroxyquinoline used in rougher tests should be approximately 2 gpl but the amount and concentration is dependent on the ore and mineral characteristics. A comparable concentration is used in cleaning in accordance with this invention. Naturally in a commercial concentration provision may be made for recovery of this reagent in the mill water from the tailings and concentrator thickener overflow and from dewatering filters.

Flotation properties of 5-hydroxyquinoline, as hereinabove stated, are also essentially the same for 2-methyl, and 4-methyl-8-hydroxyquinoline and these compounds are essentially equivalent to 5-hydroxyquinoline in the practise of this invention. The same desirable froth properties are obtained with these methyl derivatives as are obtained with the parent compound.

I believe that the less stable froth obtained in aqueous solution with 5-hydroxyquinoline compared with the 8-hydroxyquinoline compound of the prior art is owing to steric differences between these isomers. It is in any case readily verified experimentally.

The advantages of 5-hydroxyquinoline in accordance with this invention are most outstanding when this reagent is employed in its pure, or concentrated form. However, some advantage is realizable in combinations with other reagents, e.g. in a mixture of 25% 5-hydroxyquinoline and 75% 8-hydroxyquinoline.

I claim:

1. A process of froth flotation which includes agitating and aerating a pulp consisting of substantially liberated pyrochlore and associated minerals while suspended in a water solution of 5-hydroxyquinoline and collecting a rougher pyrochlore concentrate in a froth overflow and a rougher tailing in a pulp underflow.

2. A process of froth flotation which includes agitating and aerating a pulp consisting of substantially liberated pyrochlore and associated minerals while suspended in a water solution of one or more of the compounds of a class which includes 5-hydroxyquinoline, 2-methyl-5-hydroxyquinoline and 4-methyl-5-hydroxyquinoline, and collecting a rougher pyrochlore concentrate in a froth overflow and a rougher tailing in a pulp underflow.

3. In the process of claim 1, the additional step or steps of cleaning the rougher concentrate in one or multiple stages by agitating and aerating the rougher concentrate, or previous step cleaner concentrate, in an aqueous solution of 5-hydroxyquinoline and collecting a cleaner concentrate in a froth overflow and a cleaner tailing in a pulp underflow and returning said pulp underflow to a pulp feed of a preceding cleaning step or rougher feed.

* * * * *